US008159403B1

(12) United States Patent
Chen et al.

(10) Patent No.: US 8,159,403 B1
(45) Date of Patent: Apr. 17, 2012

(54) GPS MUNITIONS/ARTILLERY ANTI-JAMMING ARRAY WITH MULTI-BAND CAPABILITY

(75) Inventors: Daniel N. Chen, Diamond Bar, CA (US); James B. West, Cedar Rapids, IA (US); Lee M. Paulsen, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 1254 days.

(21) Appl. No.: 11/900,123

(22) Filed: Sep. 10, 2007

Related U.S. Application Data

(63) Continuation-in-part of application No. 11/827,329, filed on Jul. 11, 2007, now Pat. No. 8,077,099, which is a continuation-in-part of application No. 11/821,824, filed on Jun. 26, 2007.

(51) Int. Cl.
*H01Q 1/28* (2006.01)

(52) U.S. Cl. ..... 343/705; 343/708; 343/767

(58) Field of Classification Search ..... 343/705, 343/708, 767, 803
See application file for complete search history.

(56) References Cited

U.S. PATENT DOCUMENTS

| | | | | |
|---|---|---|---|---|
| 5,107,768 | A * | 4/1992 | Langenohl | 102/489 |
| 6,020,854 | A * | 2/2000 | Jagnow et al. | 343/705 |
| 6,307,514 | B1 * | 10/2001 | West | 343/705 |
| 6,378,435 | B1 * | 4/2002 | Bai et al. | 102/215 |

* cited by examiner

*Primary Examiner* — Tan Ho
(74) *Attorney, Agent, or Firm* — Donna P. Suchy; Daniel M. Barbieri

(57) ABSTRACT

The present invention is a multi-element anti-jamming (A/J) antenna array. The antenna array includes a first antenna assembly configured for being fuse-mounted a first distance from an aft end of at least one of an artillery shell and a munition. The antenna array further includes a second antenna assembly configured for being fuse-mounted a second distance from an aft end of at least one of the artillery shell and the munition, the second distance being lesser than the first distance. Further, the antenna array includes multi-band functionality.

10 Claims, 10 Drawing Sheets

GPS MUNITIONS/ARTILLERY ANTI-JAMMING ARRAY WITH MULTI-BAND CAPABILITY

CROSS-REFERENCE TO RELATED APPLICATIONS

The present application is a continuation-in-part application and claims priority under 35 U.S.C. §120 to the U.S. patent application Ser. No. 11/827,329 entitled: "Multi-Band Symmetric Phase Center Folded Monopole Antenna for GPS/Proximity Munitions Fuse Applications", filed Jul. 11, 2007, now U.S. Pat. No. 8,077,099 which in turn is a continuation-in-part application which claims priority under 35 U.S.C. §120 to the U.S. patent application Ser. No. 11/821,824 (pending) entitled: "Munitions/Artillery Shell GPS Multi-Edge Slot Anti-Jamming Array", filed Jun. 26, 2007, both of which are herein incorporated by reference in their entireties.

FIELD OF THE INVENTION

The present invention relates to the field of artillery shells/munitions/small diameter bomb platforms and more particularly to a multi-element, anti-jamming (A/J), multi-band antenna array for implementation within said artillery shells/munitions/small diameter bomb platforms.

BACKGROUND OF THE INVENTION

Artillery shells typically utilize a fuse installed at the leading end of the shell. The fuse may be a mechanical or electronic device designed to control the detonation of the explosive charge (ex—payload) of the shell. A number of currently available artillery shell fuses include electronics and telemetry systems for promoting improved accuracy and detonation control. Electronic circuits disposed in the fuse remain in radio-frequency contact with a ground station after launch of the shell for coordinating the trajectory of the shell and making course corrections as necessary. Further, the artillery fuse may operate in conjunction with a satellite-based positioning system, such as the NAVSTAR global positioning systems (GPS), maintained and operated by the United States government, for accurately determining the coordinates of the shell as it travels along its trajectory and reaches the point of impact, and for correcting the trajectories of subsequently fired munitions. GPS may also be used as a positional reference to deploy retractable airfoil flaps of an artillery shell, from a previous free fall state, to more accurately control the downward descent of the artillery shell towards the target.

An artillery shell fuse having telemetry and positioning system electronics requires an antenna suitable for the application and environment to which an artillery shell is subject. A number of currently available antennas have radiation patterns which are omni-directional in orthogonal directions about the shell trajectory and thus, may be capable of being jammed from terrestrial positions. Other currently available antennas may be subject to performance degradation effects including carrier-phase roll up, phase carrier wrap, and roll-ripple due to antenna asymmetry.

Thus, it would be desirable to have an antenna system for artillery shells which addresses the problems associated with current solutions.

SUMMARY OF THE INVENTION

Accordingly an embodiment of the present invention is directed to an artillery shell, including: a payload; a guidance system including a radio receiver; and a multi-element, anti-jamming (A/J) antenna array communicatively coupled to the radio receiver, the antenna array including a first antenna assembly and a second antenna assembly, the antenna array including multi-band functionality, wherein the first antenna assembly and the second antenna assembly are fuse-mounted antenna assemblies, the first antenna assembly being mounted a first distance from an aft end of the artillery shell, the second antenna assembly being mounted a second distance from the aft end of the artillery shell, the second distance being lesser than the first distance.

A further embodiment of the present invention is directed to a multi-element anti-jamming (A/J) antenna array, including: a first antenna assembly configured for being fuse-mounted a first distance from an aft end of at least one of an artillery shell and a munition; and a second antenna assembly configured for being fuse-mounted a second distance from an aft end of at least one of the artillery shell and the munition, the second distance being lesser than the first distance, wherein the antenna array includes multi-band functionality.

An additional embodiment of the present invention is directed to a multi-element anti-jamming (A/J) antenna array, including: a first multi-band antenna assembly configured for being fuse-mounted a first distance from an aft end of at least one of an artillery shell and a munition; and a second multi-band antenna assembly configured for being fuse-mounted a second distance from the aft end of at least one of the artillery shell and the munition, the second distance being lesser than the first distance, wherein the multi-element antenna array is a Global Positioning System (GPS) antenna array.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which:

FIG. 9A illustrates an exemplary radiation pattern for a folded monopole antenna assembly implemented as shown in FIG. 8 in accordance with an exemplary embodiment of the present invention;

DETAILED DESCRIPTION OF THE INVENTION

Reference will now be made in detail to the presently preferred embodiments of the invention, examples of which are illustrated in the accompanying drawings.

An artillery shell fuse having telemetry and positioning system electronics requires an antenna suitable for the application and environment to which an artillery shell is subject. The antenna should be able to survive the extreme acceleration and high rotational velocities typical of gun-launched projectiles. Further, the radiation pattern of the antenna telemetry should exhibit relatively high gain in the aft direction (i.e., the direction opposite the direction of travel of the shell), while the radiation pattern for the GPS system should be minimal in the direction of travel of the shell to minimize or prevent jamming from the vicinity of the target area of the shell. Such an antenna should be of sufficiently reduced size so as not to occupy a large amount of space within the interior of the fuse, and is preferably designed for operation with L-band and S-band signals. ("L" being the letter designation for microwave signals in the frequency range from 1 to 2 GHz; "S" being the letter designation for microwave signals in the frequency range from 2 to 4 GHz).

Figure 1:
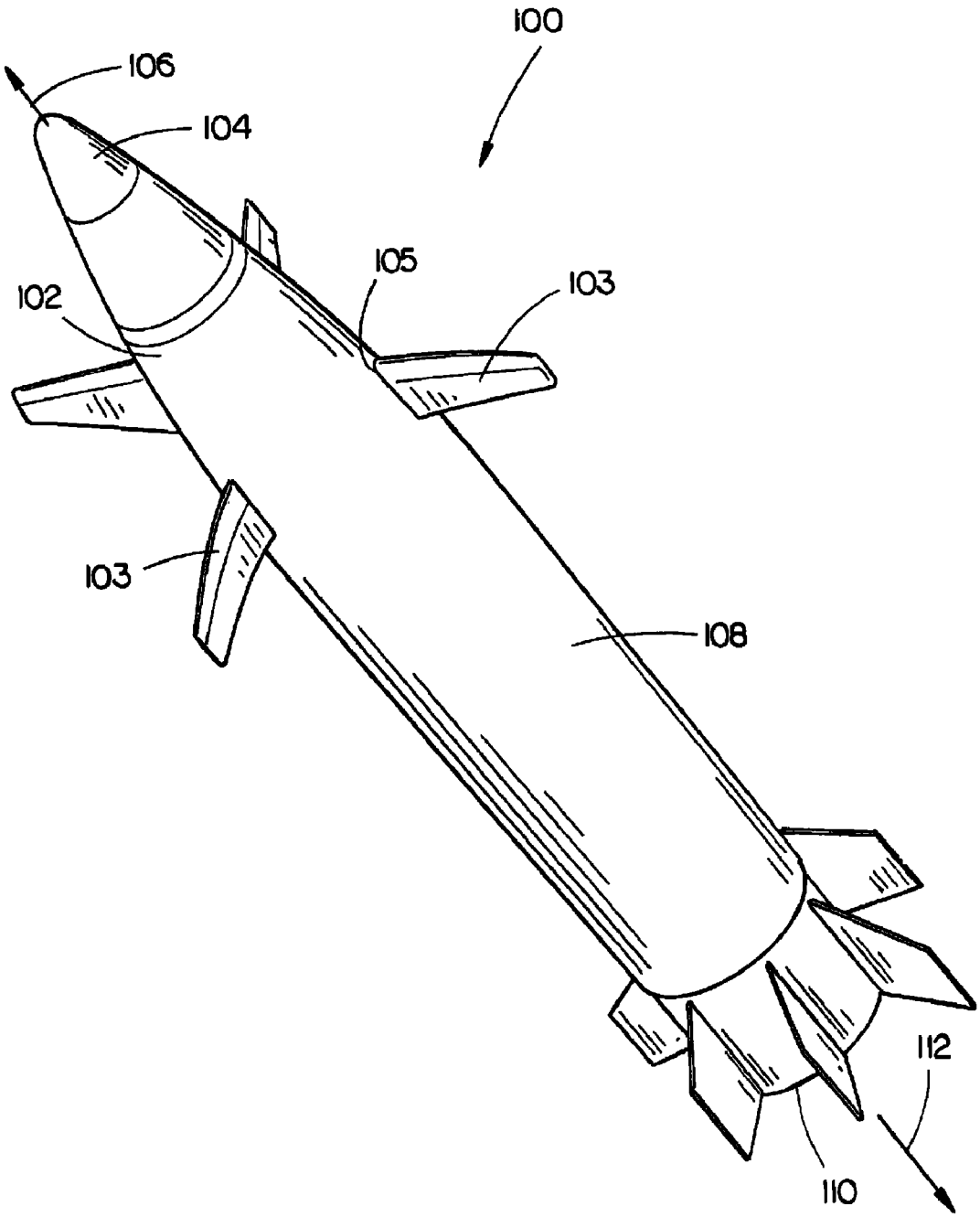
FIG. 1 is an illustration of an artillery shell in accordance with an exemplary embodiment of the present invention.

Referring now to FIG. 1, an artillery shell in accordance with the present invention is shown. The artillery shell 100 or similar munition is typically launched or fired from a cannon, mortar, or similar type of gun (not shown). A fuse 104 is disposed at the nose 102 of the artillery shell 100 and is typically physically contiguous with the body 108 of the shell. The fuse 104 may be a mechanical or electronic device utilized for detonating an explosive charge, such as the charge or payload of the artillery shell 100 or similar munition. The artillery shell 100, when launched or otherwise projected, generally travels in a forward direction 106 toward the vicinity of a target. During flight, the rear 110 of the artillery shell 100 generally points in the aft direction 112 toward the vicinity of origin of the shell (ex—toward the gun from which the shell was launched). In exemplary embodiments, during flight, retractable airfoil flaps 103 or any like selectively deployable airfoil mechanism may be deployed to change the trajectory of the shell 100. Retractable airfoil flaps 103 are shown as extending from slots 105.

Figure 10A:
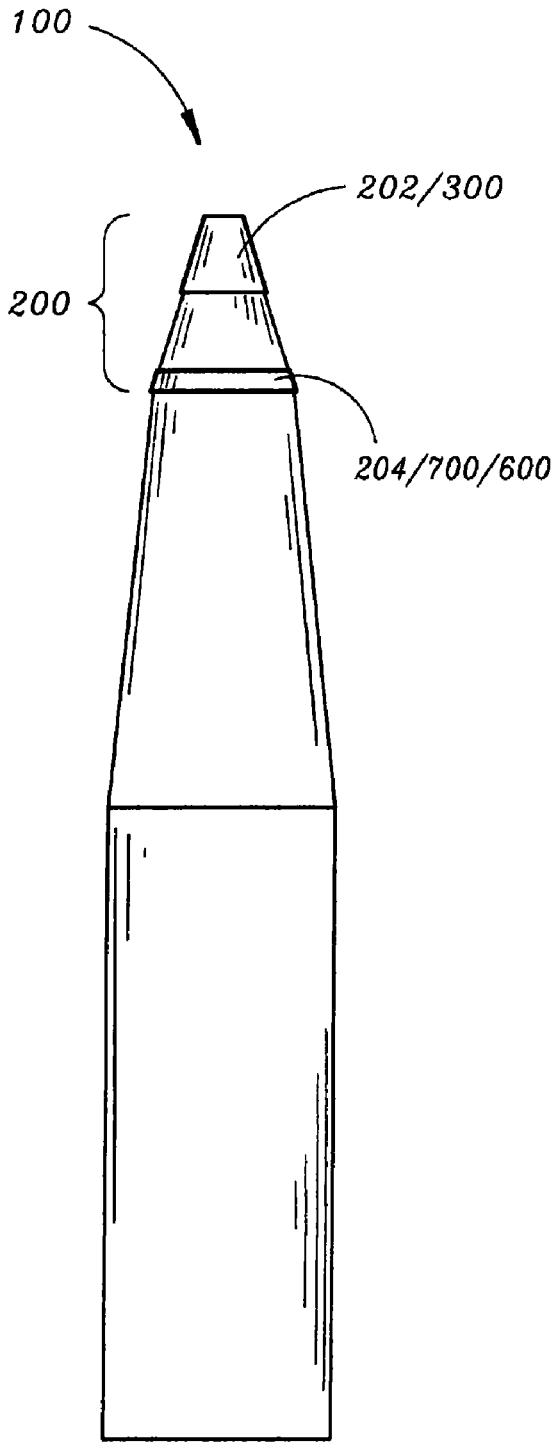
FIG. 10A illustrates a cutaway view of an artillery shell implementing an antenna array(s) in accordance with exemplary embodiments of the present invention.
Figure 10B:
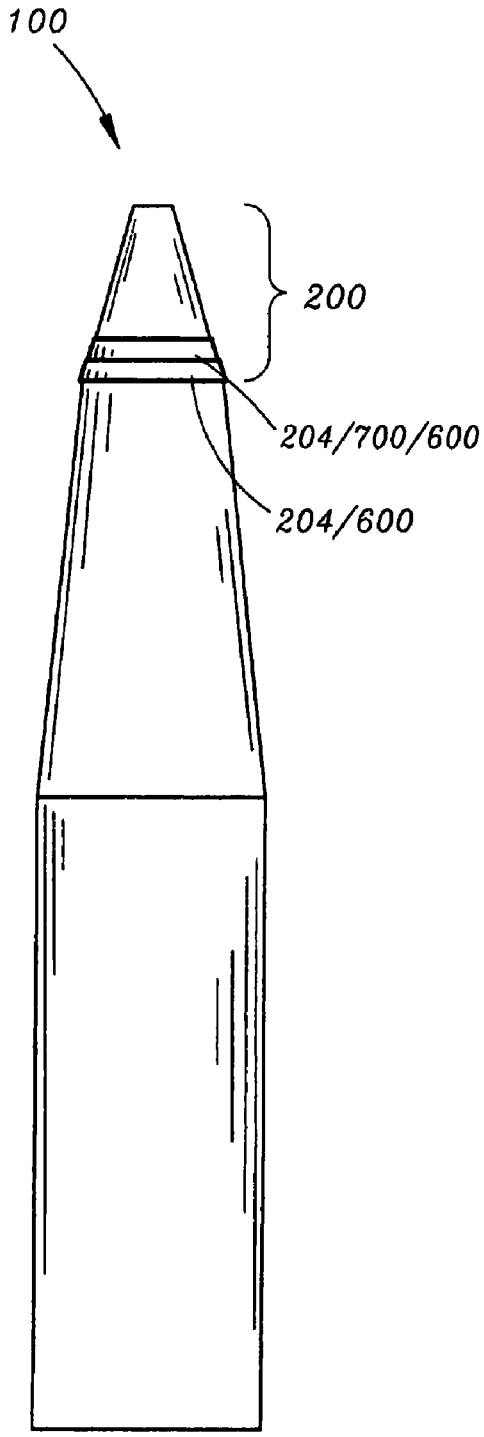
FIG. 10B illustrates a cutaway view of an artillery shell implementing an antenna array(s) in accordance with alternative exemplary embodiments of the present invention.

Referring generally to FIGS. 10A and 10B, an antenna array 200 in accordance with exemplary embodiments is shown. In a present embodiment, the antenna array 200 may be a multi-element array (ex—a 2-element array) including a first antenna assembly 202 and a second antenna assembly 204. Further, the first antenna assembly 202 and the second antenna assembly 204 may each be configured for being implemented within an artillery shell or munition 100. Still further, the first antenna assembly 202 and the second antenna assembly 204 may each be configured for being fuse-mounted within the artillery shell/munition 100. In an exemplary embodiment, the first antenna assembly 202 may be mounted a first distance from an aft end (ex—rear) 110 of the artillery shell 100, while the second antenna assembly 204 may be mounted a second distance from the aft end 110 of the artillery shell 100, with the second distance being lesser than the first distance.

Figure 8:
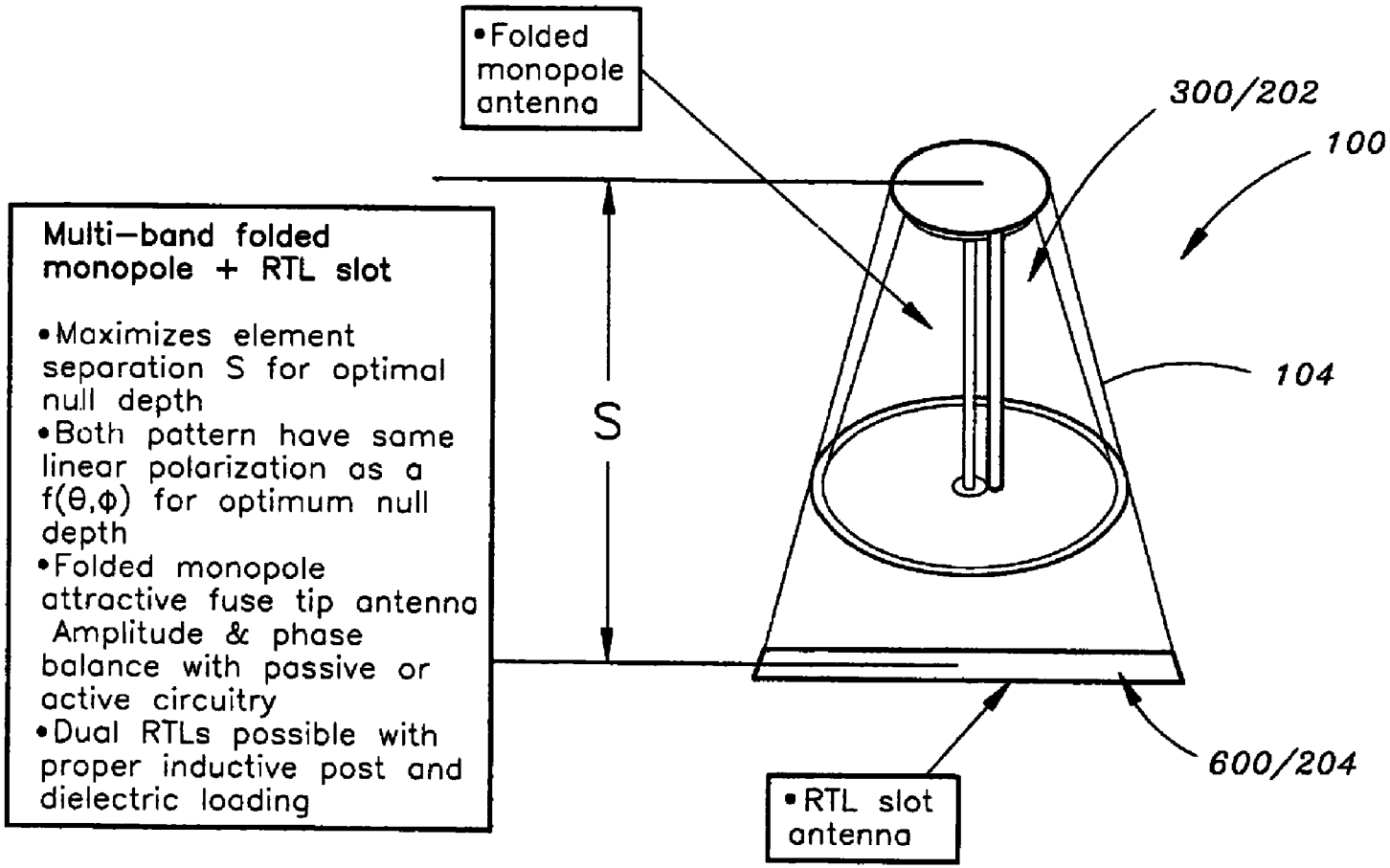
FIG. 8 is a cutaway view of a multi-element anti-jamming (A/J) antenna array implementing a folded monopole antenna assembly and a radial transmission line antenna assembly in accordance with an exemplary embodiment of the present invention.

In a current embodiment of the present invention (as shown in FIGS. 8 and 10A), the first antenna assembly 202 of the antenna array 200 may be a folded monopole antenna assembly. For example, the folded monopole antenna assembly implemented in the present invention may be a folded monopole antenna assembly as described in U.S. patent application Ser. No. 11/827,329 (pending) entitled: "Multi-Band Symmetric Phase Center Folded Monopole Antenna for GPS/Proximity Munitions Fuse Applications", filed Jul. 11, 2007, which is hereby incorporated by reference in its entirety. Further, the second antenna assembly 204 of the antenna array 200 may be a radial transmission line (RTL) (i.e., edge slot) antenna assembly (as shown in FIGS. 8 and 10A). For instance, the radial transmission line (RTL) antenna assembly/edge slot antenna assembly/circumferential slot antenna assembly implemented in the present invention may be a radial transmission line (RTL) (i.e., edge slot) antenna assembly as described in U.S. Pat. No. 6,098,547 entitled: "Artillery Fuse Circumferential Slot Antenna for Positioning and Telemetry" which is hereby incorporated by reference in its entirety.

Figure 3A:
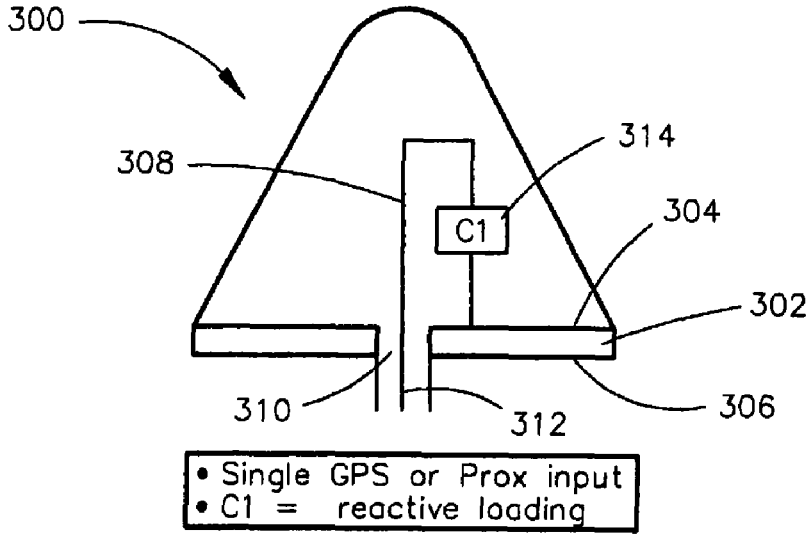
FIG. 3A is an end view of a folded monopole antenna assembly including a folded monopole antenna having a single reactive circuit in accordance with an exemplary embodiment of the present invention.

Referring generally to FIGS. 3A through 4C, exemplary embodiments of a folded monopole antenna assembly of the present invention, (which may be configured for implementation as the first antenna assembly 202 of the antenna array 200 within at least one of an artillery shell 100, a munition, or a small diameter bomb platform) are shown. In a current embodiment of the present invention, as shown in FIG. 3A, a folded monopole antenna assembly 300 may include a dielectric substrate 302. For example, the dielectric substrate may be formed of Teflon® fiber-glass, or similar RF (Radio Frequency) dielectric material. Further, the dielectric substrate 302 may be a printed circuit board (PCB). In additional embodiments, the dielectric substrate 302 may be metal-plated (ex—copper-plated), such as on an upper surface (ex—upper ground) 304 of the substrate 302 and a lower surface (ex—lower ground) 306 of the substrate 302.

In exemplary embodiments, the folded monopole antenna assembly 300 may include a folded monopole antenna 308. Further, the folded monopole antenna 308 may be configured for being connected with the dielectric substrate 302. In current embodiments of the present invention, the folded monopole antenna 308 may be connected to the dielectric substrate 302 by being mounted to the dielectric substrate 302 (ex—as a surface mount configuration). Alternatively, the folded monopole antenna 308 may be connected to the dielectric substrate 302 by being embedded within the dielectric substrate 302 (ex—as an embedded passive configuration). Further, the dielectric substrate (and the antennas 308, antenna assembly 300) may be "potted" into the shape of the artillery shell/munition fuse tip 104 for promoting aerodynamics and environmental robustness of the folded monopole antenna assembly 300. For example, the potted dielectric substrate 302 may be a Printed Circuit Board (PCB) having the profile of the fuse tip 104. Further, the dielectric substrate 302 may be constructed of conventional microwave printed circuit materials which may allow said substrate to be sized/constructed so as to have fuse-compatible dimensions.

In current embodiments of the present invention, the folded monopole antenna 308 may be a Global Positioning System (GPS) antenna or a Proximity Fuse (Prox) antenna. In additional embodiments, the folded monopole antenna 308 may be a multi-band antenna. For example, the folded monopole antenna 308 may be configured for supporting one or more of: an L1 GPS frequency (ex—1.575 GHz), an L2 GPS frequency (ex—1.227 GHz) or other L-band frequencies, such as L3, L5 or the like. In further embodiments, the folded monopole antenna 308 may support S-band frequencies (such as for telemetry and control) and/or C-band frequencies (such as for Height of Burst (HOB)-related direction finding).

In further embodiments of the present invention, the dielectric substrate 302 may be configured for receiving at least one input. For instance, the dielectric substrate 302 may have an aperture 310 formed therethrough for receiving an input, such as an input pin/pin probe 312. For example, the pin probe 312 may be an extension of a center conductor of a L1/L2 coaxial feed for providing a common L1/L2 input. The folded monopole antenna assembly 300 may be fed via the input pin 312, such that each of the radiating elements of the folded monopole antenna 308 are simultaneously excited in-phase. Further, the folded monopole antenna assembly 300 may be used in conjunction with one or more feed circuits, matching circuits and/or diplexors. For instance, the input 312 of the folded monopole antenna assembly 300 may be impedance-matched to a characteristic impedance of an RF feed, feed circuit, matching circuit, diplexor, or an RF transceiver assembly via an additional shielded RF microstrip layer or perpendicular (to a fuselage axis 318) stripline circuit board (ex—an RF match board), such as via numerous known techniques. For example, the RF match board may be integrated into the RF transceiver assembly. Further, such feed circuits/diplexors may provide a local ground plane for the folded monopole antenna assembly 300 that ties to a fuselage ground. In additional embodiments, the folded monopole antenna 308 may be further configured for receiving a signal via the received input 312.

Figure 2:
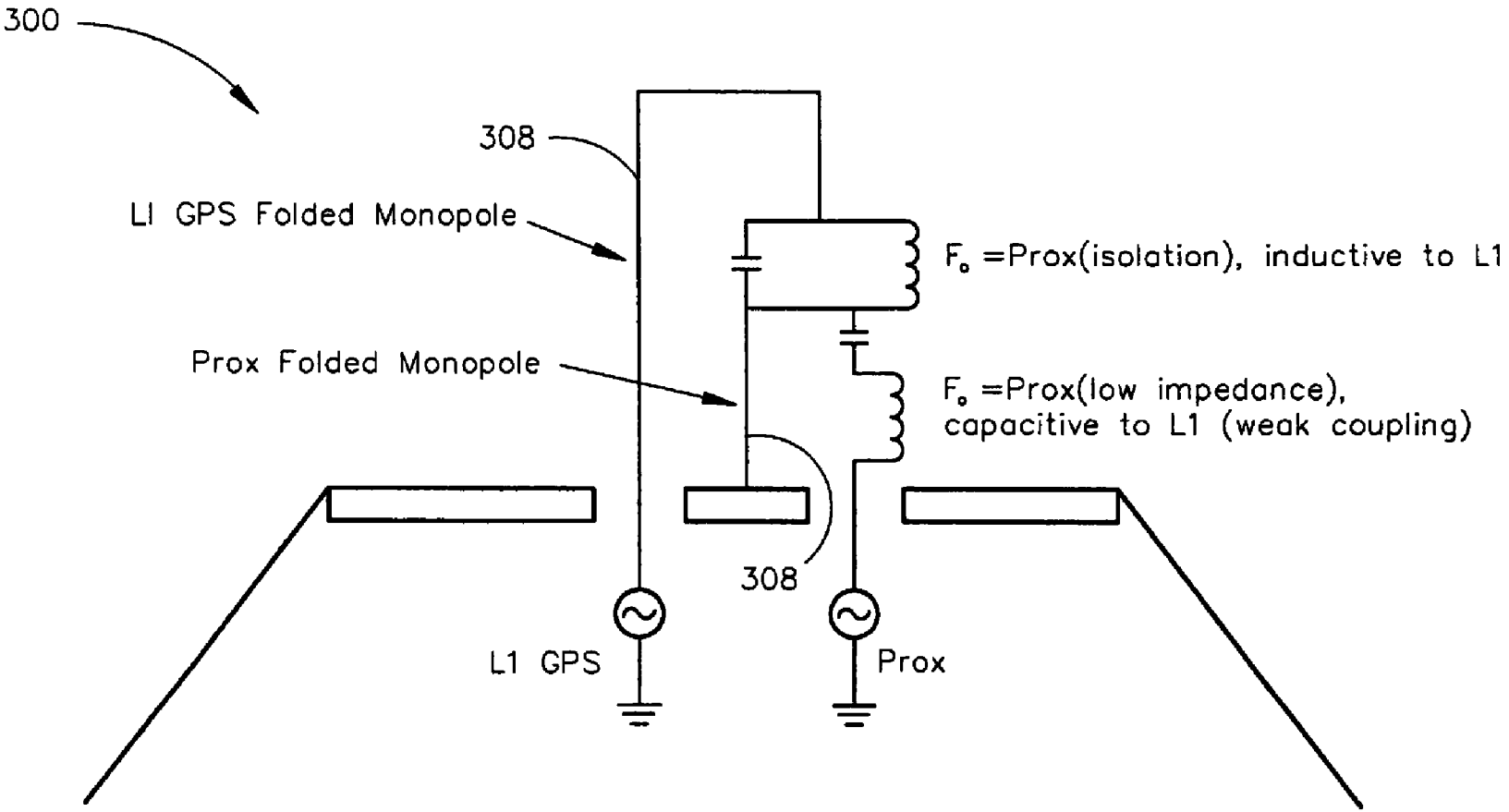
FIG. 2 is an illustration of a folded monopole antenna assembly implementing reactive loading via a reactive circuit in accordance with an exemplary embodiment of the present invention.

As discussed above, the folded monopole antenna 308 of the present invention may be a multi-band antenna (ex—may allow for simultaneous L1 GPS, L2 GPS, C Band, Proxy Fuse functionality, L Band data link functionality (for certain applications, and the like). In an exemplary embodiment, the folded monopole antenna 308 may include at least one reactive circuit 314, the reactive circuit being configured for providing multi-band functionality to the folded monopole antenna 308. For example, various known techniques such as reactive loading, LC reactive traps/tanks, reactive tank loading, material loading, inductive tapped feed loading, capacitive top loading, transformer impedance matching, and/or the like may be implemented for providing multi-band functionality to the folded monopole antenna assembly 300 of the present invention and for providing a reactively loaded folded monopole antenna assembly 300. FIG. 2 illustrates a folded monopole antenna assembly 300 which includes two folded monopole antennas 308 (ex—an L1 GPS folded monopole antenna and a Proximity Fuse/Prox folded monopole antenna) and further illustrates an example of the implementation of reactive tank loading via the at least one reactive circuit 314 for providing the above-referenced multi-band functionality to the folded monopole antennas 308.

Figures 4A, 4B, 4C:
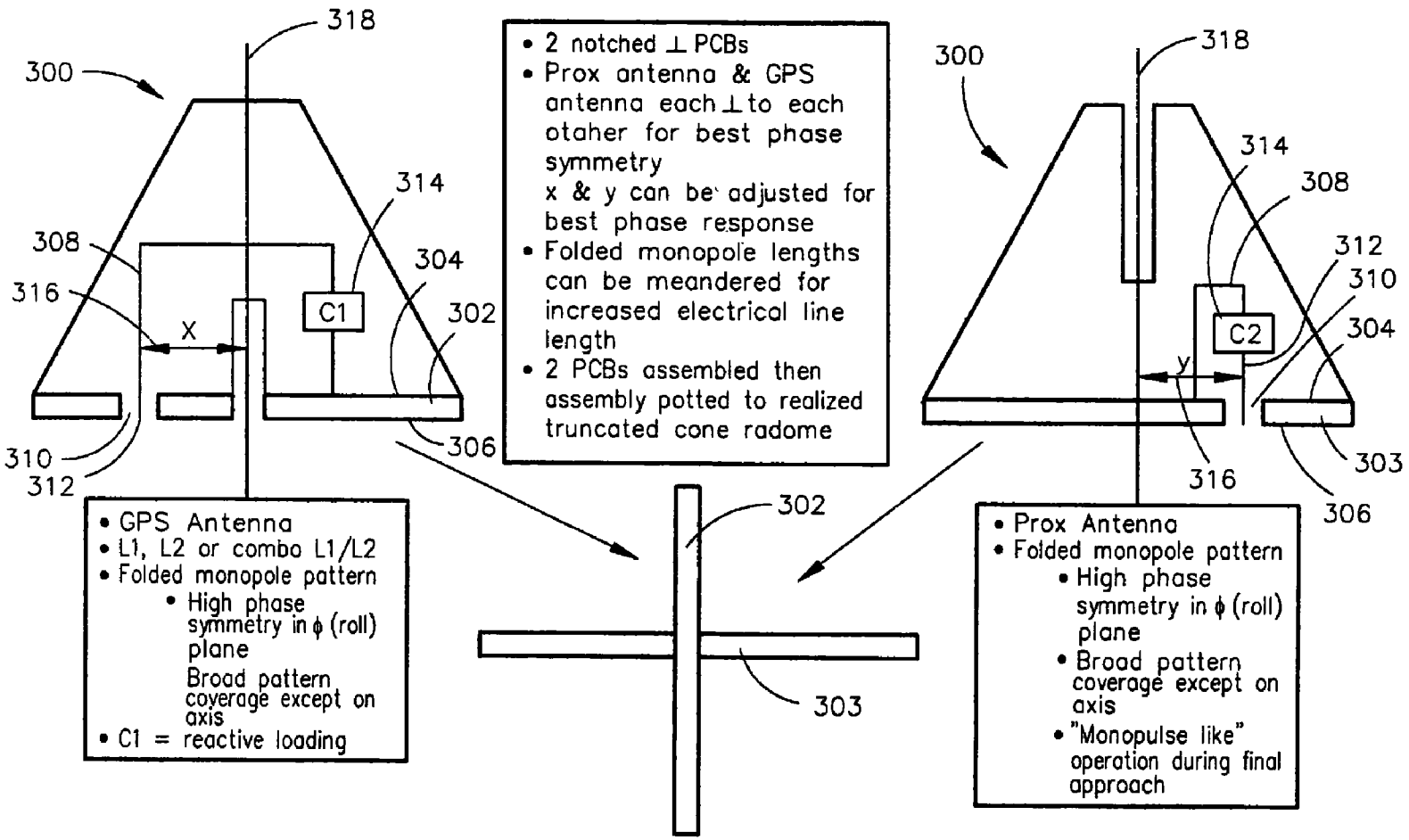
FIG. 4A is an end view of a folded monopole antenna assembly including a GPS folded monopole antenna having a single reactive circuit in accordance with an exemplary embodiment of the present invention.
FIG. 4B is an end view of a folded monopole antenna assembly including a Proximity Fuse folded monopole antenna having a single reactive circuit in accordance with an exemplary embodiment of the present invention.
FIG. 4C is a perspective view of a folded monopole antenna assembly including a plurality of folded monopole antennas, each antenna connected to one of two perpendicularly connected printed circuit boards in accordance with alternative exemplary embodiments of the present invention.

As discussed above, the folded monopole antenna assembly 300 may be configured for being mounted within a fuse tip 104 of at least one of an artillery shell 100 and a munition. In further embodiments, the folded monopole antenna 308 may be selectively positionable along a first axis 316 (as shown in FIGS. 4A and 4B), which is generally perpendicular to or transverse with respect to a second axis 318 (ex—a fuselage axis of the artillery shell 100) for adjusting an apparent phase center of the folded monopole antenna 308 to achieve a desired phase center response.

In exemplary embodiments, the folded monopole antenna 308 may be electrically small (ex—the largest dimension of an antenna in the array is no more than one-tenth of a wavelength), such as via implementation of wire (trace) meandering in its construction, for providing an antenna 308 with short effective height, which may promote: increased conduction current path/increased electrical line lengths for lower resonant frequency and/or improved radiation efficiency for the antenna 308 across relatively narrow bandwidths.

In further embodiments, the folded monopole antenna 308 of the antenna assembly 300 may be constructed as a bent wire structure "fixtured" with (ex—mounted to or embedded in) the dielectric substrate 302. Further, the folded monopole antenna 308 may include various lumped circuit topologies, such as multi-resonant lumped circuit topologies (ex—the reactive circuit 314). For instance, the reactive circuit 314 may include one or more circuit components, such as lumped resistors (R), inductors (L) and/or capacitors (C) which may be metallurgically bonded to the bent wire structure prior to potting of the antenna assembly 300 within the fuse tip 104 of the artillery shell 100.

The folded monopole antenna(s) 308 of the folded monopole antenna assembly 300 of the present invention may promote the provision of desired radiation patterns. For example, the folded monopole antenna(s) 308 of the folded monopole antenna assembly 300 of the present invention may allow for provision of wide (azimuthal, elevational) pattern coverage during a large percentage of a flight trajectory of an artillery shell 100/munition with an axial pattern null to final approach Anti-Jamming (A/J). As discussed above, in exemplary embodiments of the present invention, the folded monopole antenna assembly 300 may provide simultaneous multi-band (ex—L1/L2) GPS functionality which may allow for exploitation of inherent linear polarization and axial phase center/axial phase symmetry for promoting GPS accuracy and minimization of phase carrier wrap/phase wrapping effect which is often a problem with spinning vehicles (ex—spinning artillery shells, munitions).

Figure 3B:
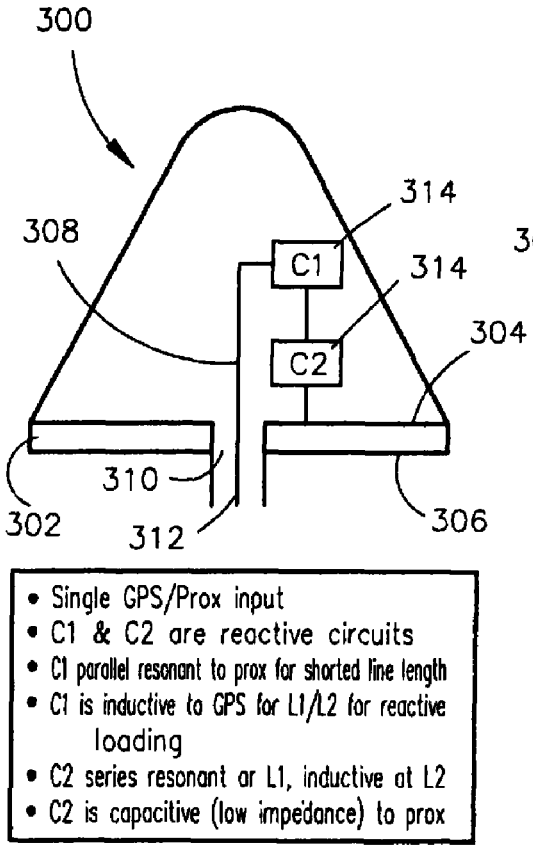
FIG. 3B is an end view of a folded monopole antenna assembly including a folded monopole antenna having a plurality of reactive circuits in accordance with a further exemplary embodiment of the present invention.
Figure 3C:
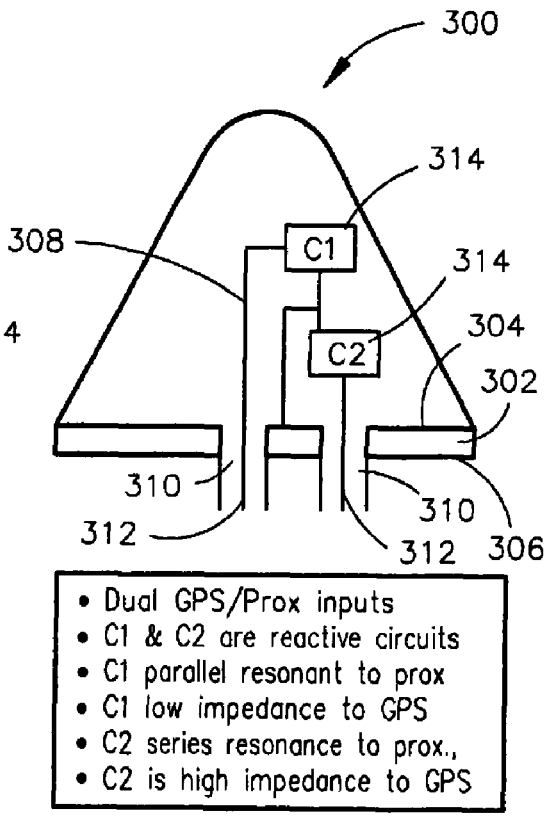
FIG. 3C is an end view of a folded monopole antenna assembly including dual inputs in accordance with an additional exemplary embodiment of the present invention.

The present invention contemplates various embodiments of the folded monopole antenna assembly. FIG. 3A illustrates a folded monopole antenna assembly 300 which may include a single folded monopole antenna 308 (ex—a GPS or Prox antenna) connected with a single dielectric substrate 302, the folded monopole antenna 308 being fed via a single input 312 (ex—a GPS or Prox input) and including a single reactive circuit 314. (ex—for providing reactive loading). In further embodiments, the folded monopole antenna assembly 300 of the present invention may implement multiple reactive circuits 314. For example, FIG. 3B illustrates a folded monopole antenna assembly 300 in which a first reactive circuit (ex—C1) and a second reactive circuit (ex—C2) are implemented with a single folded monopole antenna 308. In the embodiment illustrated in FIG. 3B, the first reactive circuit (C1) may be parallel resonant to prox for shortened line length, and may be inductive to GPS for L1/L2 for reactive loading. Further, the second reactive circuit (C2) may be series resonant at L1, may be inductive at L2, and may be capacitive (low impedance) to prox. FIG. 3C illustrates a folded monopole antenna assembly 300 in which multiple (ex—dual) inputs 312 are implemented with a single folded monopole antenna 308 which includes multiple reactive circuits 314, such as a first reactive circuit (C1) and a second reactive circuit (C2). In the embodiment illustrated in FIG. 3C, the first reactive circuit (C1) may be parallel resonant to prox and may be low impedance to GPS. Further, the second reactive circuit (C2) may be series resonant to prox and may be high impedance to GPS.

As discussed above, the folded monopole antenna assembly 300 may implement one or more folded monopole antennas 308, such as a GPS folded monopole antenna and/or a Prox antenna. FIG. 4A illustrates an embodiment in which the antenna assembly 300 implements a single GPS folded monopole antenna 308, which includes a single reactive circuit (C1) (ex—for reactive loading). For example, the GPS folded monopole antenna 308 may be an L1, L2 or combination L1/L2 GPS folded monopole antenna. The antenna assembly 300 shown in FIG. 4A may promote high phase symmetry in a roll (phi) plane and broad pattern coverage (except on fuselage axis 318). FIG. 4B illustrates an alternative embodiment in which the antenna assembly implements a single Prox folded monopole antenna 308, which includes a single reactive circuit (C2). The folded monopole antenna assembly 300 shown in FIG. 4B may promote high phase symmetry in a roll (phi) plane and broad pattern coverage (except on fuselage axis 318). Further, the antenna assembly shown in FIG. 4B may provide "monopulse-like" operation during final approach of the artillery shell 100.

FIG. 4C illustrates an alternative embodiment of the folded monopole antenna assembly 300 of the present invention. In FIG. 4C, the folded monopole antenna assembly 300 includes a first dielectric substrate 302. The folded monopole antenna assembly 300 further includes a second dielectric substrate 303 configured for being connected with the first dielectric substrate 302. For example, the dielectric substrates (302, 303) may be Printed Circuit Boards (PCBs) which may generally have a same profile as the fuse tip of the artillery shell 100. In the exemplary embodiment, each dielectric substrate (302, 303) may be configured for receiving one or more inputs 312. The folded monopole antenna assembly 300 may further include first and second folded monopole antennas 308. The first folded monopole antenna 308 may be configured for being connected with one of the first dielectric substrate 302 and the second dielectric substrate 303. For example, the first and second folded monopole antennas 308 may each be connected with the same dielectric substrate (ex—both connected with 302, while substrate 303 acts to provide fixturing/rigidity for the antenna assembly 300) or different dielectric substrates (ex—first folded monopole antenna connected with first dielectric substrate 302, second folded monopole antenna connected with second dielectric substrate 303). For instance, each folded monopole antenna 308 may be configured for receiving a signal via the input(s) 312 received by the dielectric substrate (302 or 303) with which that antenna 308 is connected. Each folded monopole antenna 308 may include one or more reactive circuits 314. In alternative embodiments, multiple antennas 308 may be included on one or both of the substrates (302, 303).

In the embodiment shown in FIG. 4C, the first dielectric substrate 302 may form a slot 305 and the second dielectric substrate 303 may form a slot 307, said substrates (302, 303) configured for being connected to each other/keyed to one another via the indexing slots (305, 307). For instance, when connected, the dielectric substrates (302, 303) may be connected/assembled perpendicularly with respect to one another (as shown in FIG. 4C) for promoting improved phase symmetry. For instance, once assembled, the folded monopole antenna assembly 300 of FIG. 4C may be potted such that it configures to the profile of the fuse tip 104, such as a truncated cone radome of an artillery shell 100.

As discussed above, implementation of the folded monopole antenna assembly 300 of the present invention may promote production of a rotationally symmetric radiation pattern (ex—promote provision of rotationally symmetric phase center properties). Additionally, the folded monopole assembly 300 of the present invention may promote production of a radiation pattern which has a gain of 0 dB or better over much of the pattern. Also, the folded monopole antenna assembly 300 of the present invention may provide hemispherical coverage and may promote maximized GPS satellite reception and GDOP (Geometric Dilution of Precision). In embodiments in which multiple folded monopole antennas 308 (ex—a GPS antenna and a Prox antenna) are implemented, said antennas 308 may be independent and orthogonal to one another within the fuse tip 104 of the artillery shell 100.

As discussed above, in a current embodiment of the present invention, the second antenna assembly 204 of the antenna array 200 may be a radial transmission line (RTL) (i.e., edge slot) antenna assembly. For instance, the radial transmission line (RTL) antenna assembly/edge slot antenna assembly/circumferential slot antenna assembly implemented in the present invention may be a radial transmission line (RTL) (i.e., edge slot) antenna assembly as described in U.S. Pat. No. 6,098,547 entitled: "Artillery Fuse Circumferential Slot Antenna for Positioning and Telemetry" which is hereby incorporated by reference in its entirety.

Figure 6A:
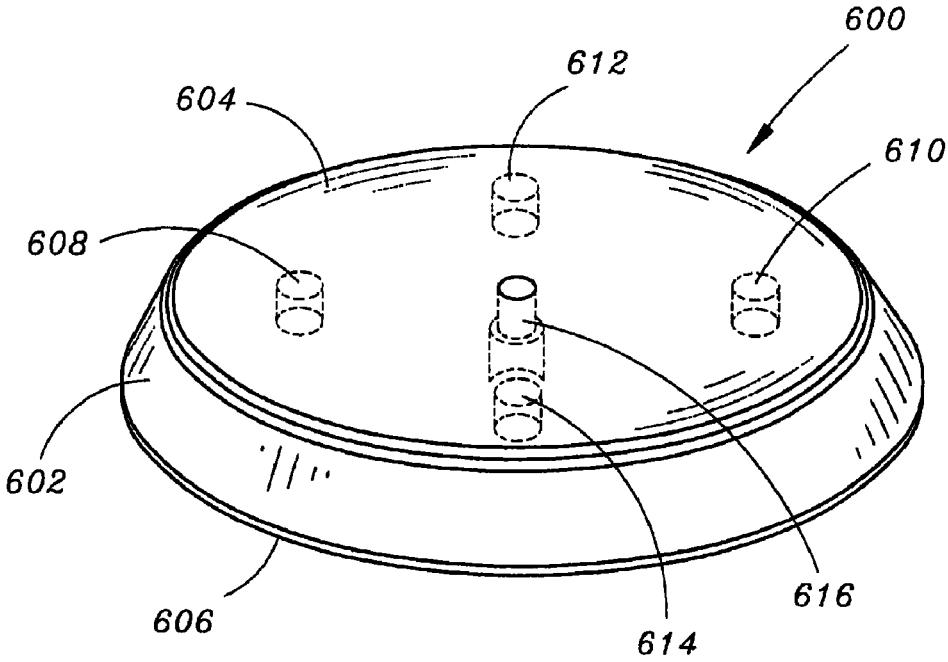
FIG. 6A is an isometric view of a radial transmission line antenna assembly in accordance with an exemplary embodiment of the present invention.
Figure 6B:
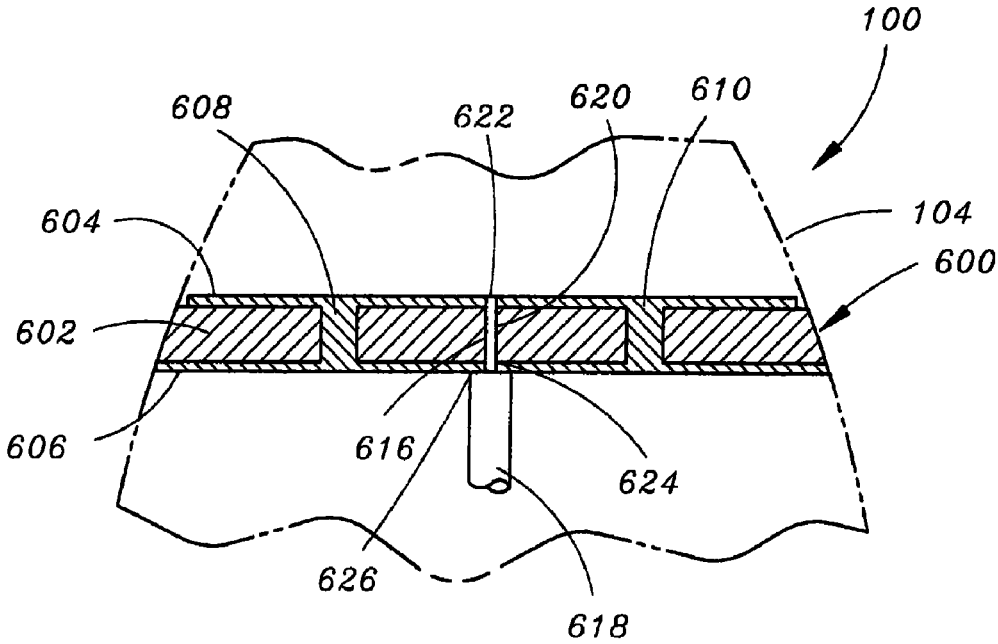
FIG. 6B is a cutaway view of a radial transmission line antenna assembly implemented within an artillery shell in accordance with an exemplary embodiment of the present invention.

Referring generally to FIGS. 6A and 6B, an exemplary embodiment of an RTL antenna assembly of the present invention, (which may be configured for implementation as the second antenna assembly 204 of the antenna array 200 within at least one of an artillery shell 100, a munition, or a small diameter bomb platform) is shown. The RTL antenna assembly 600 may be a disk-shaped structure defined by a dielectric disk 602, as shown in FIG. 6A. The dielectric disk 602 may include a top ground plane 604 and a bottom ground plane 606 disposed on top and bottom surfaces of the dielectric disk 602. The dielectric disk 602 may insulate ground planes 604 and 606, thereby forming a circumferential slot configuration antenna.

In further embodiments, dielectric disk 602 of the RTL antenna assembly 600 may be constructed of a low loss dielectric material (ex—material which has a dielectric constant between 3 and 4). Further, the dielectric disk 602 may be constructed of conventional microwave printed circuit materials which may allow said disk 602 to be sized/constructed so as to have fuse-compatible dimensions. Additionally, the RTL antenna assembly 600 may be formed by depositing the ground planes 604 and 606 on a circuit board type material which has been formed into a discoid structure via metal deposition such that ground planes 604 and 606 may be metallization layers on opposite surfaces of the dielectric disk 602. In additional embodiments, the dielectric disk 602 (and ground planes 604, 606) of the RTL antenna assembly 600 may have one or more apertures 608, 610, 612, 614 formed therethrough, said apertures may be spaced apart and radially disposed with respect to a center of the dielectric disk 602. For embodiments of the RTL antenna assembly which implement metal ground planes 604, 606, metal may also be deposited on interior surfaces of the disk which are formed by the apertures (608-614) such that the ground planes 604, 606 may be electrically coupled via the apertures (608-614). In such configurations, the apertures (608-614) may form inductive posts that may tune the center frequency and bandwidth of the RTL antenna assembly 600 via inductive loading. Through inductive loading, the apertures (608-614) may increase effective electrical size of the RTL antenna assembly 600 without altering its physical diameter.

In additional embodiments, the dielectric disk 602 may have a central aperture 616 formed therethrough for allowing a conductor of RF feed 618 to couple to the dielectric disk 602. For example, as shown in FIG. 6B, a center conductor 620 of RF feed 618 may be connected to ground plane 604 at point 622. Further, an outer conductor 624 of RF feed 618 may be connected to ground plane 606 at point 626. As discussed above, the RTL antenna assembly 600 may be implemented within an interior of the fuse 104 (ex—fuse-mounted) of an artillery shell/munition 100. Electronic circuitry of the artillery shell 100 may couple with the RTL antenna assembly 600 via the RF feed transmission line 618. For instance, the RF feed 618 may be a coaxial cable having electrical characteristics which are compatible with the RTL antenna assembly 600 and the electronic circuitry of the artillery shell 100 (e.g., having a characteristic impedance suitable for coupling the impedance of the RTL antenna assembly to the output or input impedance of the electronic circuitry). Additionally, the RTL antenna assembly 600 and electronic circuitry may be utilized in the fuse 104 to provide telemetry and positioning functions for the shell 100, such as auto-registration, range control, accuracy improvement, tracking, detonation control and the like.

Figure 9B:
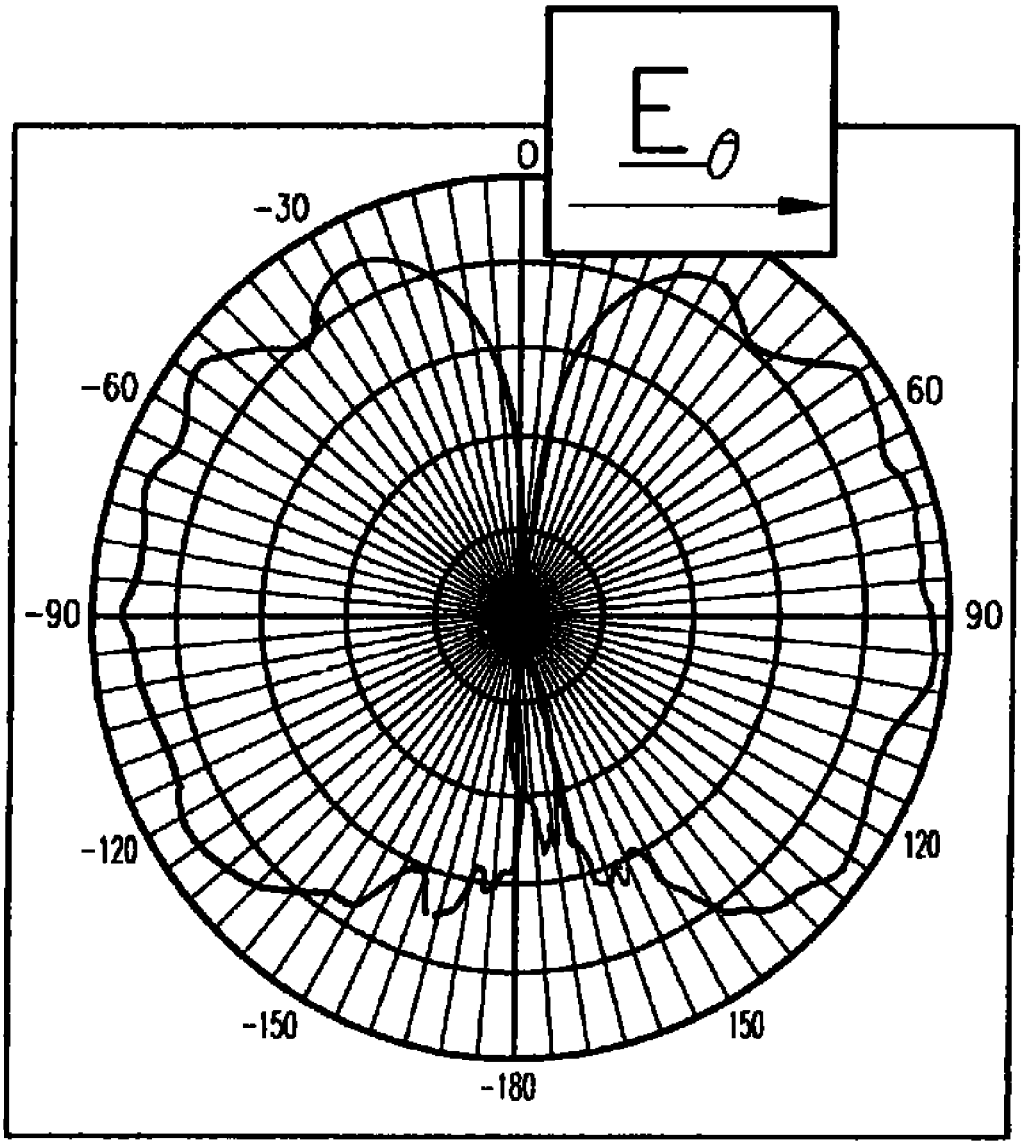
FIG. 9B illustrates an exemplary radiation pattern for a radial transmission line antenna assembly implemented as shown in FIG. 8 in accordance with an exemplary embodiment of the present invention.

The RTL antenna assembly 600, when implemented in the antenna array 200 of the present invention, may provide a rotationally symmetric "monopole-like" radiation pattern. Further, like the folded monopole assembly 300 described above, the RTL antenna assembly 600 may allow for provision of wide (az., el.) pattern coverage during large percentage of flight trajectory with axial pattern null to final approach A/J. FIGS. 9A and 9B show radiation patterns produced by the folded monopole antenna assembly 300 (See FIG. 9A) and the RTL antenna assembly (See FIG. 9B) when the folded monopole antenna assembly 300 is implemented as the first antenna assembly 202 and the RTL antenna assembly 600 is implemented as the second antenna assembly 204 of the antenna array 200 in accordance with exemplary embodiments of the present invention (as shown in FIGS. 8, 10A). Further, the RTL antenna assembly 600, when implemented in the antenna array 200 of the present invention may allow for far field phase symmetry in roll axis to be realized by judicious placement of shunt inductive posts (ex—608-614).

In current embodiments of the present invention, the RTL antenna assembly 600, when implemented in the antenna array 200 of the present invention, may provide simultaneous multi-band (ex—L1/L2) GPS functionality which may allow for exploitation of edge slot inherent linear polarization (LP) and axial phase center/axial phase symmetry for promoting GPS accuracy and minimization of phase carrier wrap/phase wrapping effect which is often a problem with spinning vehicles (ex—spinning artillery shells, munitions).

In the embodiment described above, the first antenna assembly 202 (ex—folded monopole antenna assembly 300) of the antenna array 200 and the second antenna assembly 204 (ex—RTL antenna assembly 600) may be fuse-mounted within the artillery shell (See FIGS. 8, 10A). Further, the first antenna assembly 202 may be mounted a first distance from the aft end 110 of the shell 100, while the second antenna assembly 204 may be mounted a second distance from the aft end of the shell 100, the second distance being shorter than the first distance. Thus, the first antenna assembly 202 serves as the forward antenna (ex—proximal to tip of fuse 104), while the second antenna assembly 204 serves as the aft antenna (ex—proximal to bottom section of fuse 104). As shown in FIG. 8, this embodiment may allow for/provide a multi-element anti-jamming (A/J) array which maximizes antenna assembly separation (S) on the fuse/fuselage 104, thereby providing optimal null depth. Further, the embodiment shown in FIG. 8 (first antenna assembly=folded monopole, second antenna assembly=RTL) allows amplitude and phase balance to be attained via passive or active circuitry.

In exemplary embodiments, the antenna assemblies (202, 204) of the antenna array 200 may be theta polarized, which may allow for provision of maximum anti-jamming (A/J) performance by the antenna array 200 and may further allow for implementation of the array in handheld GPS A/J applications. Further, the co-polarized elements/antenna assemblies (202, 204) may permit maximal utilization of classic array factor calculations in null positioning and generation (such as employed in extant A/J processors). Still further, the co-polarized elements/antenna assemblies (202, 204) may promote improved/greater null depth capability.

In additional embodiments, both the first antenna assembly 202 and the second antenna assembly 204 of the antenna array 200 may be RTL antenna assemblies (see FIG. 10B), such as those described above, and such as those further described in U.S. patent application Ser. No. 11/821,824 (pending) entitled: "Munitions/Artillery Shell GPS Multi-Edge Slot Anti-Jamming Array", filed Jun. 26, 2007, which is herein incorporated by reference in its entirety. The antenna array 200 of the present invention may implement multiple RTL antenna assemblies (ex—tip/first antenna assembly=RTL antenna assembly, and aft/second antenna assembly=RTL antenna assembly) via proper (i.e., judicious) shunt inductive post loading and/or judicious dielectric loading (which may make the tip/first RTL antenna assembly very small.

In further embodiments, the first antenna assembly 202 (ex—the tip-mounted or forward antenna assembly) may be a folded monopole antenna assembly 300, such as described above and in U.S. patent application Ser. No. 11/827,329 (pending) entitled: "Multi-Band Symmetric Phase Center Folded Monopole Antenna for GPS/Proximity Munitions Fuse Applications", filed Jul. 11, 2007, which is hereby incorporated by reference in its entirety. Further, the second antenna assembly 204 (ex—the lower fuse section-mounted or aft antenna assembly) may be a multi-element sectoral circular slot antenna array/circular slot array/circular circumferential slot array (see FIG. 10A), such as described in U.S. Pat. No. 6,307,514 entitled: "Method and System for Guiding an Artillery Shell" which is hereby incorporated by reference in its entirety.

Figure 7A:
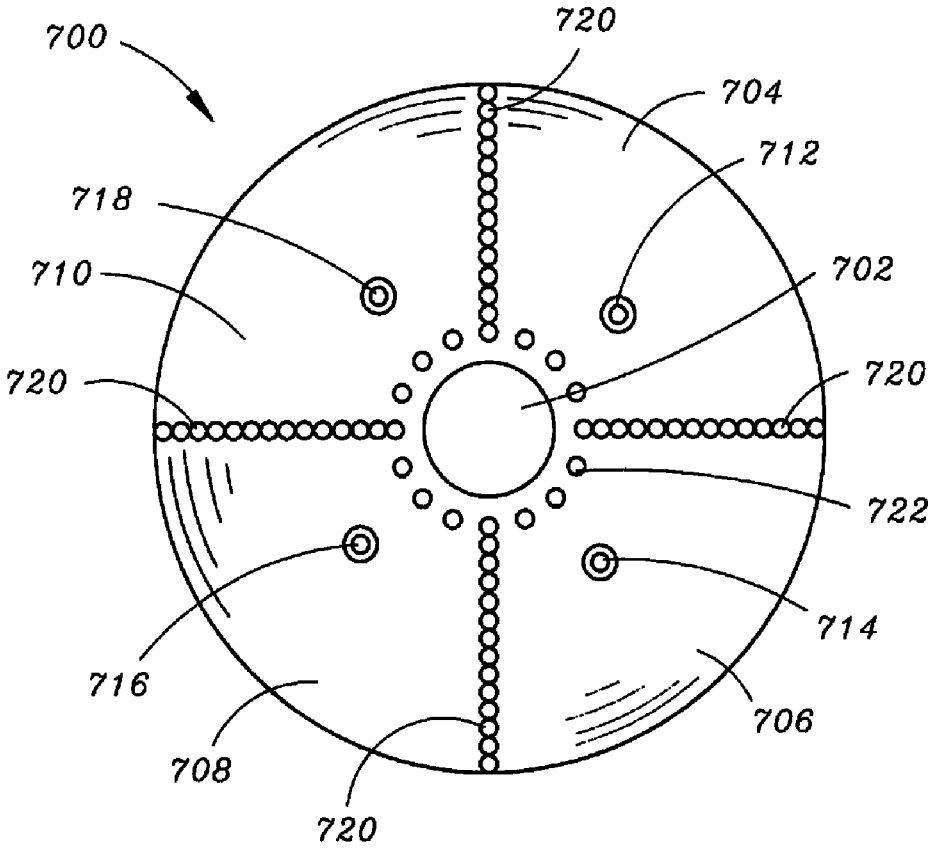
FIG. 7A is a top plan view of a circular circumferential slot array in accordance with an exemplary embodiment of the present invention.
Figure 7B:
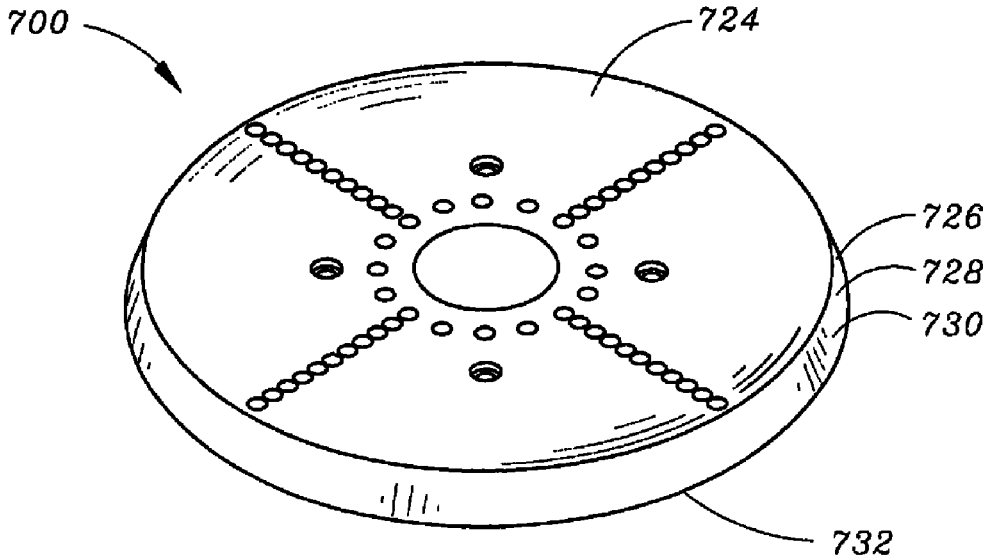
FIG. 7B is an end view of a circular circumferential slot array in accordance with an exemplary embodiment of the present invention.

Referring generally to FIGS. 7A and 7B, a circular circumferential slot array, which may be implemented as the first or second antenna assembly (202, 204) in the antenna array 200 of the present invention is shown. In an exemplary embodiment, the circular circumferential slot array 700 may include a centrally disposed airfoil actuator pin 702, a first antenna element 704, a second antenna element 706, a third antenna element 708 and a fourth antenna element 710. The antenna elements (704, 706, 708 and 710) may have disposed therethrough/therein apertures for receiving a first coaxial feed input 712, a second coaxial feed input 714, a third coaxial feed input 716 and a fourth coaxial feed input 718, respectively. The circular circumferential slot array 700 may be formed via a single dielectric disk having a central aperture 211 formed therethrough. The disk may be divided into separate antenna elements by radiating element separation ground via walls 720, which may be plated-through holes, which may form shorting walls for isolating the neighboring antenna elements (704-710) from each other. Each antenna element may be separated from the central airfoil actuator pin 702 by an inner via ground isolation ring 722, which may be similar to radiating element separation ground via wall 720.

Further, the circular circumferential slot array 700 may include a top ground plane 724, an antenna dielectric 726 (ex—the disk having the central hole 702 formed therethrough), a middle ground plane 728, a splitter/combiner dielectric 730 and a micro strip line 732, which may also be a strip line. Known techniques of antenna manufacture, design, tuning, etc. may be employed to arrive at a particular design for a particular need. Known techniques of impedance matching may be employed in designing and feeding the circular circumferential slot array 700 of the present invention. For example, the coaxial feed inputs (712-718) may be combined through an impedance matching/power splitter circuit and/or switching circuit. Diameter and location of the coaxial feed inputs (712-718) within the antenna elements (704-710) may be adjusted to facilitate impedance matching. Slot aperture coupling between the circular circumferential slot array 700 and a matching/circuit/switch may be used instead of coax feeds.

In current embodiments of the present invention, an omnidirectional mode may be realized when all antenna elements (704-710) of the circular circumferential slot array 700 are fed in phase, which may be accomplished via an N way Wilkenson or equivalent splitter network located on the underside of the array 700. Micro strip line 732 may be a component of such an N way Wilkenson splitter network. In further embodiments, the circumferential slot array 700 may also be configured with an adjustable switching network and/or phase shifting network for performing radiation pattern synthesis, which may be done via known techniques employed in an electronic circuit board. The number of antenna elements (704-710) may be varied. For instance, implementing fewer (ex—two) antenna elements may produce a directional pattern perpendicular to the artillery shell 100 fuselage, which may be maintained skyward in a non-spinning missile application to reject ground based, or low altitude jammer signals, as well as terrestrial ground noise. In spinning artillery shell 100 embodiments, the sectoral antenna elements (704-710) may be commutated in sync with a rotation rate of the artillery shell 100, such that only upward directed radiating elements would be enabled at any point in the trajectory of the shell 100.

In exemplary embodiments, the elements (704-710) of the circular slot array 700 may be phased together to form a normal circumferential RTL slot antenna for use with the folded monopole tip antenna assembly 300 in the antenna array 200 of the present invention. Further, as discussed above, the elements (704-710) of the circular slot array 700 may be commutated in sync w/an RPM spin rate of the artillery shell/munition 100 to have an "ever up looking" radiation pattern for promoting immunity to ground jammer signals. Still further, the circular slot array 700 of the present invention may be driven in a mode similar to a circumferential array of radiating elements mounted to the fuselage surface 104 of the artillery shell 100.

In additional embodiments, the antenna array 200 of the present invention may implement an RTL antenna assembly 600 as its first antenna assembly 202 (ex—the tip-mounted or forward antenna assembly), while implementing a circular circumferential slot array 700 as its second antenna assembly 204 (ex—the lower fuse section-mounted or aft antenna assembly). (See FIG. 10B). The RTL antenna assembly 600 may be as described above and/or as described in U.S. Pat. No. 6,098,547 entitled: "Artillery Fuse Circumferential Slot Antenna for Positioning and Telemetry" which is hereby incorporated by reference in its entirety. The circular circumferential slot array 700 may be as described above and/or as described in U.S. Pat. No. 6,307,514 entitled: "Method and System for Guiding an Artillery Shell" which is hereby incorporated by reference in its entirety. This embodiment may result in an antenna array 200 which provides the above-described advantages associated with implementation of the RTL antenna assembly 600 and with implementation of the circular circumferential slot array 700.

By including two or more multi-element antenna assemblies as described above, the antenna array 200 may promote maximized anti-jamming (A/J) performance may provide an anti-jamming array with maximized antenna/antenna assembly separation on the fuse 104. For example, the antenna assemblies may be conformal antenna assemblies (sized so as not to perturb general shape of the projectile) which may be implemented within the artillery shell 100 and may be configured for receiving signals (such as GPS signals) via electronics (ex—DIGNU/IGS—Deeply Integrated Guidance Navigation Unit/Inertial Guidance System) contained within the artillery shell 100 for promoting course or trajectory correction functionality for the artillery shell (as will be described further below). Further each of the antenna assemblies 202, 204 of the array 200 may implement multiple ground layers, such as RF ground layers and may further implement multiple dielectric layers. Further, as described previously, multiple frequencies may be supported by each antenna assembly 202, 204.

In additional embodiments, the antenna array 200 and/or one or both of the first antenna assembly 202 and the second antenna assembly 204 may be frequency scaled for providing a simplified direction guidance system for guiding an emitter signal into a null of the antenna's radiation pattern for a power detection based steering system, which may promote neutralization of jammer signal emitters in some CONOPS (Concept of Operations) scenarios.

Figure 5:
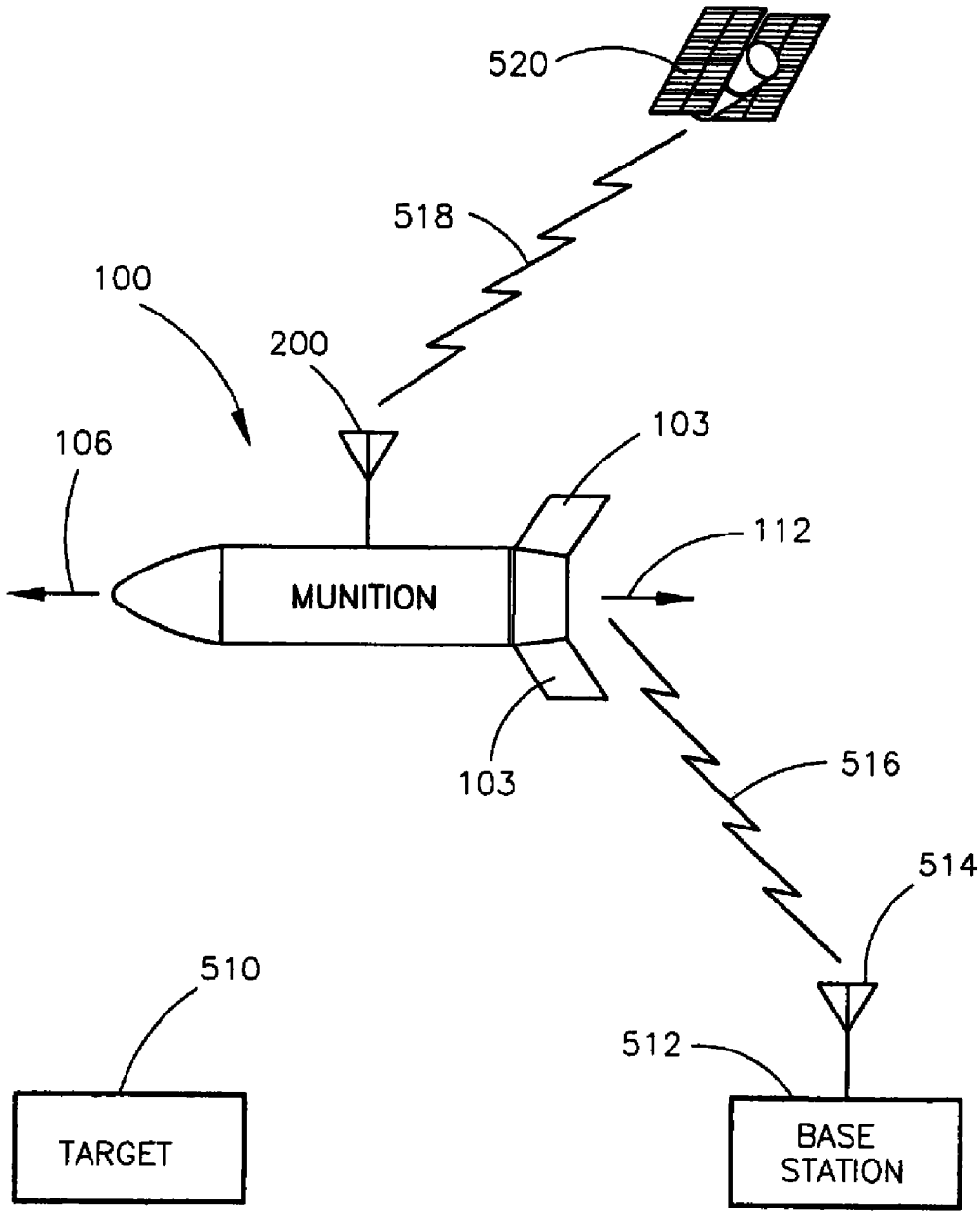
FIG. 5 is a communications schematic for an artillery shell/munition implementing an antenna array of the present invention in accordance with an exemplary embodiment of the present invention.

Referring now to FIG. 5, there is shown a system of the present invention, which includes an artillery shell 100, which has been launched in a typical manner. The artillery shell 100 is moving in a forward direction 106 along a trajectory generally directed toward a target 510. The artillery shell has come from/originated from a rearward/aft direction 112 along the trajectory. In exemplary embodiments, it may be desirable to change the trajectory of the artillery shell 100, while said shell is in flight, in order to assure proper interaction with the target 510. In current embodiments of the present invention, the artillery shell 100 includes an on-board GPS receiver which continuously monitors the shell's position via a space directed signal 518 from satellite 520. The antenna array 200 may receive these GPS or other signals and may make course corrections either locally or via telemetry. Further, the antenna array may make other communications with a base station 512, through a terrestrial RF signal 516, and base station antenna 514. In additional embodiments, commands may be sent to the artillery shell 100 to deploy its retractable airfoil flaps 103, so as to change the aerodynamics, speed, and therefore, trajectory of the artillery shell 100. Still further, other signals, such as detonation commands for airborne detonation (of an explosive charge/payload of the shell), could be sent to the artillery shell 100 as well.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An artillery shell, comprising:

a payload;

a guidance system including a radio receiver; and a multi-element, anti-jamming (A/J) antenna array communicatively coupled to the radio receiver, the antenna array including a first antenna assembly and a second antenna assembly, the antenna array including multi-band functionality, wherein the first antenna assembly and the second antenna assembly are fuse-mounted antenna assemblies, the first antenna assembly being mounted a first distance from an aft end of the artillery shell, the second antenna assembly being mounted a second distance from the aft end of the artillery shell, the second distance being lesser than the first distance, the first antenna assembly being a folded monopole antenna assembly, the second antenna assembly being one of: a radial transmission line (RTL) antenna assembly and a circular circumferential slot array.

2. An artillery shell as claimed in claim 1, wherein the multi-element antenna array is configured for supporting at least one of: L-band frequencies, S-band frequencies and C-band frequencies.

3. An artillery shell as claimed in claim 1, wherein the multi-element antenna array is a Global Positioning System (GPS) antenna array.

4. An artillery shell as claimed in claim 1, wherein the first antenna assembly and the second antenna assembly are theta polarized.

5. A multi-element anti-jamming (A/J) antenna array, comprising:

a first antenna assembly configured for being fuse-mounted a first distance from an aft end of at least one of an artillery shell and a munition; and a second antenna assembly configured for being fuse-mounted a second distance from an aft end of at least one of the artillery shell and the munition, the second distance being lesser than the first distance, wherein the antenna array includes multi-band functionality, the first antenna assembly being a folded monopole antenna assembly, the second antenna assembly being one of: a radial transmission line (RTL) antenna assembly and a circular circumferential slot array.

6. A multi-element anti-jamming (A/J) antenna array as claimed in claim 5, wherein the multi-element antenna array is configured for supporting at least one of: L-band frequencies, S-band frequencies and C-band frequencies.

7. A multi-element anti-jamming (A/J) antenna array as claimed in claim 5, wherein the multi-element antenna array is a Global Positioning System (GPS) antenna array.

8. A multi-element anti-jamming (A/J) antenna array as claimed in claim 5, wherein the first antenna assembly and the second antenna assembly are theta polarized.

9. A multi-element anti-jamming (A/J) antenna array, comprising:

a first multi-band antenna assembly configured for being fuse-mounted a first distance from an aft end of at least one of an artillery shell and a munition; and a second multi-band antenna assembly configured for being fuse-mounted a second distance from the aft end of at least one of the artillery shell and the munition, the second distance being lesser than the first distance, wherein the multi-element antenna array is a Global Positioning System (GPS) antenna array, the first antenna assembly being a radial transmission line antenna assembly, the second antenna assembly being a circular circumferential slot array.

10. A multi-element anti-jamming (A/J) antenna array as claimed in claim 9, wherein the multi-element antenna array is configured for supporting at least one of: L-band frequencies, S-band frequencies and C-band frequencies.

* * * * *